US005628353A

United States Patent [19]

Rüther

[11] Patent Number: 5,628,353

[45] Date of Patent: May 13, 1997

[54] METHOD AND DEVICE FOR WITHDRAWING A LIQUID FROM A SEALED GLASS AMPOULE

[75] Inventor: Horst Rüther, Hart/Graz, Austria

[73] Assignee: AVL Medical Instruments AG, Schaffhausen, Switzerland

[21] Appl. No.: 490,007

[22] Filed: Jun. 13, 1995

[30] Foreign Application Priority Data

Jul. 28, 1994 [AT] Austria ..... 1497/94

[51] Int. Cl.[6] ..... B67C 9/00

[52] U.S. Cl. ..... 141/330; 141/1; 141/97; 422/102; 222/87; 225/93; 225/103

[58] Field of Search ..... 141/1, 18, 21, 141/97, 250, 391, 329, 330, 319, 320, 98; 222/81–88, 136; 241/99, 101.2, 101.5, 606; 225/93, 96.5, 97, 103; 422/102, 104; 604/200

[56] References Cited

U.S. PATENT DOCUMENTS

| | | | |
|---|---|---|---|
| 1,680,616 | 8/1928 | Horst | 141/330 |
| 3,380,636 | 4/1968 | Ushkow et al. | 225/103 |
| 3,892,237 | 7/1975 | Steiner | 604/200 |
| 3,999,451 | 12/1976 | Ogle | 225/93 |
| 4,497,349 | 2/1985 | Fraley | 141/19 |
| 4,506,817 | 3/1985 | Parker | 225/96.5 |
| 4,604,965 | 8/1986 | Dehais | 118/219 |
| 4,808,381 | 2/1989 | McGregor et al. | 422/102 X |
| 5,012,845 | 5/1991 | Averette | 141/329 |
| 5,037,549 | 8/1991 | Ballies | 422/102 X |
| 5,041,267 | 8/1991 | Randtke et al. | 422/102 |
| 5,179,024 | 1/1993 | Dahms | 422/102 X |
| 5,220,947 | 6/1993 | Cauquil et al. | 141/91 |
| 5,221,311 | 6/1993 | Rising et al. | 422/102 X |
| 5,344,780 | 9/1994 | Nonboe | 422/102 X |
| 5,382,409 | 1/1995 | Baxter | 422/102 |

*Primary Examiner*—J. Casimer Jacyna
*Attorney, Agent, or Firm*—Watson Cole Stevens Davis, P.L.L.C.

[57] ABSTRACT

For the purpose of automatically drawing a liquid from a sealed glass ampoule the latter is held in a support in upright position with the ampoule bottom facing upwards, and the bottom is destroyed mechanically by inserting a withdrawing element. The liquid content of the ampoule is then sucked from a splinter-free zone of the glass ampoule.

11 Claims, 1 Drawing Sheet

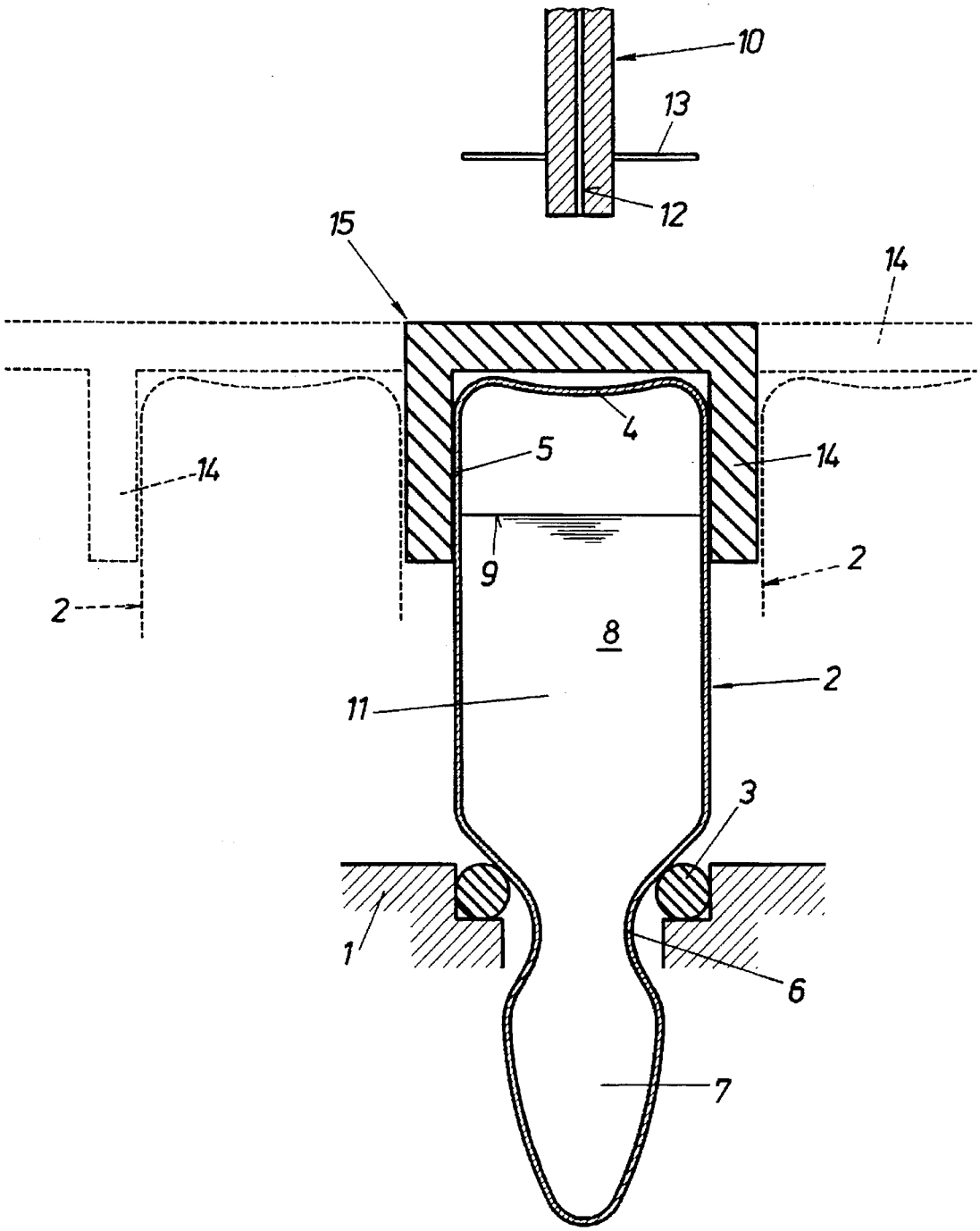
10
13
12
15
14
4
5
14
14
9
2
2
8
2
11
3
1
6
7

METHOD AND DEVICE FOR WITHDRAWING A LIQUID FROM A SEALED GLASS AMPOULE

BACKGROUND OF THE INVENTION

The invention relates to a method and device for withdrawing a liquid from a sealed glass ampoule, which ampoule is held in upright position, its bottom facing upwards.

In medical laboratories as well as in doctor's practices and hospitals a large number of ampoules or glass vials are handled, which contain a variety of liquids, such as liquid drugs, or liquids for calibration or quality control. Such ampoules must be opened by hand before use.

In a number of applications, especially in the instance of quality control of laboratory equipment by means of quality control liquids, the manipulations involved in handling such liquids if they are contained in glass ampoules, are far from convenient. Other storage containers suitable for quality control liquids, however, such as bags or plastic bottles, are undesirable as the liquid parameters may be subject to changes if the liquids are kept in storage for any length of time, which would render them useless.

DESCRIPTION OF THE PRIOR ART

In this context an automatic injecting device is presented in U.S. Pat. No. 3,892,237, in which a glass ampoule is held in an upright position, the bottom of the ampoule facing upwards. By means of a mechanically actuated element the tip of the ampoule can be broken, which will induce the pressurized contents to flow into a vial made of deformable plastic. During injection of the liquid contents the plastic vial is deformed by the force of a preloaded spring, and an injection needle is ejected from the injection device, which will penetrate into a depth that has been adjusted beforehand. Such a device is not suited for automated processes in laboratory equipment, however.

SUMMARY OF THE INVENTION

It is an object of the invention to propose a method and a device for the automatic withdrawal of a liquid from a sealed container, in particular concerning the withdrawal of quality control liquids from glass ampoules.

In the invention this object is achieved by mechanically destroying the bottom of the glass ampoule by introducing a withdrawing element, and by sucking liquid from a splinter-free zone of the glass ampoule. It has been found unexpectedly that, after the bottom off the ampoule has been destroyed by the withdrawing element, some of the particles of shattered glass will settle in the throat or tip of the ampoule, while others will remain on the surface of the liquid due to the prevailing surface tension. In between the two areas a splinter-free zone is found from which the contents of the ampoule can be drawn without difficulties.

In a further development of the invention it is proposed that the ampoule be removed automatically from a reservoir containing a large number of ampoules.

After the bottom of the ampoule has been destroyed mechanically, it is proposed in a preferred embodiment of the invention to wait for a preset period of time before withdrawing the liquid, in order to ensure that all glass particles have settled and left the zone of liquid withdrawal.

In the invention a device for drawing a liquid from a sealed glass ampoule is provided with a withdrawing element, which is introduced through the bottom of the ampoule, and which comprises a cannula for withdrawing the liquid from a splinter-free zone of the ampoule.

In a variant of the invention the withdrawing element is configured as a cannula with stiff walls of sufficient rigidity to permit mechanical destruction of the bottom of the glass ampoule. It would also be possible, however, to provide a separate part of the withdrawing element for destroying the ampoule bottom.

To ensure that all glass particles will settle it is proposed in a further development of the invention that the tip of the withdrawing element be provided with a flexible membrane whose exterior diameter corresponds to the interior diameter of the glass ampoule.

The invention also permits the use of fine-pored filtering material inside the cannula, which material should preferably be made of stainless steel.

Suitable measures facilitating the breaking open of the ampoules include the use of a specifically shaped bottom, e.g., of U-shaped cross-section, or a bottom which is thinner than that of typical ampoule series. Moreover, the glass surface of the ampoules could be coated with an elastomer to retain the glass splinters in the area of the ampoule.

In a preferred variant of the invention the bottom of the glass ampoule and the adjacent shaft is encased in an elastomer part. According to the invention the elastomer parts of several glass ampoules may be combined to form a one-way carrier element for transport and storage of the ampoules.

Slipping an elastomer part over the bottom and lower shaft area of a glass ampoule has several advantages. As the elastomer part adheres to the glass fewer glass splinters will drop into the ampoule. The splinters will remain in the ampoule area and will not be scattered in the surroundings. The site where the glass is pierced remains covered apart from the opening through which the withdrawing element is inserted. Despite this opening no liquid remains will leave the ampoule after the withdrawing process even if the ampoule is tipped up. If soft elastomer components are used the opening through which the liquid is drawn will reseal itself. In this way noxious odors given off by aging liquids can be reduced considerably.

DESCRIPTION OF THE DRAWING

Following is a more detailed description of a preferred variant of the invention as illustrated by the accompanying drawing.

The device is provided with a support 1 in which a glass ampoule 2 is held, preferably elastically, by means of a sealing ring 3. The glass ampoule 2 comprising a bottom 4, shaft 5, throat 6 and tip 7, contains a liquid 8 (calibrating or quality control liquid, or liquid drug) with a surface 9. Due to its upright position and its bottom 4 facing upwards, the ampoule 2 can be opened by inserting a withdrawing element 10 into its bottom 4 in such a way that the latter is mechanically destroyed. The particles of shattered glass will partly settle in the throat 6 or tip 7 of the ampoule 2, or they will float, due to the surface tension of the liquid 8, on the surface 9. In this manner a splinter-free zone 11 is created between the throat 6 and the surface 9 of the liquid, from which liquid may be drawn by means of the cannula 12 in the withdrawing element 10.

To ensure that all glass particles will settle, a flexible membrane 13 may be attached to the withdrawing element 10, which will push the glass particles below the surface after it has been dipped into the liquid.

The bottom 4 of the ampoule 2 and the shaft 5 adjacent to the bottom are encased in an elastomer part 14, which will prevent the glass splinters from being scattered outside the ampoule.

The elastomer parts 14 of several glass ampoules 2 can be combined into a one-way carrier element 15. By using a blunt, hard object to open the ampoule, such as the thick-walled cannula 12, little or no wear is to be expected throughout its operating life.

I claim:

1. A method for withdrawing a liquid from within a sealed glass ampoule, comprising the following steps:

a) providing a sealed glass ampoule containing a liquid, b) holding said glass ampoule in an upright position, with a glass bottom of said glass ampoule facing upwards, c) passing a withdrawing element through said glass bottom of said glass ampoule to mechanically destroy said glass bottom and create glass splinters, d) sucking said liquid from a splinter-free zone of said glass ampoule with said withdrawing element.

2. A method according to claim 1, wherein said glass ampoule is removed automatically from a reservoir containing a large number of said ampoules.

3. A method according to claim 1, wherein, after mechanically destroying the bottom of said glass ampoule, said liquid is withdrawn only after a preset period of waiting.

4. A device for withdrawing a liquid from a sealed glass ampoule comprising a support in which said sealed glass ampoule is held in an upright position, the glass bottom of said ampoule facing upwards, and a withdrawing element which is introducible through said glass bottom of said glass ampoule to mechanically destroy said glass bottom and create glass splinters, said withdrawing element comprising a rigid cannula having stiff walls and one lumen for withdrawing said liquid from a splinter-free zone of said glass ampoule.

5. A device according to claim 4, wherein a tip of said withdrawing element is provided with a flexible membrane having an exterior diameter corresponding to an interior diameter of said glass ampoule.

6. A device according to claim 4, wherein the lumen of said cannula is provided with fine-pored filtering material.

7. A device according to claim 4, wherein said bottom of said glass ampoule and an adjacent shaft of said glass ampoule are encased in an elastomer part.

8. A device according to claim 7, wherein said elastomer part of several glass ampoules are combined to form a one-way carrier element for transport and storage of said glass ampoules.

9. A device according to claim 4, wherein said bottom of said glass ampoule has a U-shaped cross-section.

10. A device according to claim 4, wherein said bottom of said glass ampoule is configured as a thin-wall bottom.

11. A device according to claim 4, wherein a surface of said glass ampoule is coated with an elastomer.

* * * * *